US005398427A

United States Patent [19]

Tolson

[11] Patent Number: 5,398,427

[45] Date of Patent: Mar. 21, 1995

[54] APPARATUS AND METHOD FOR DIFFERENTIALLY SHRINKING SELECTED PORTIONS OF HEAT SHRINKABLE FILM WRAPPED AROUND A PRODUCT

[75] Inventor: Sidney S. Tolson, Scotland Neck, N.C.

[73] Assignees: Ossid Corporation, Rocky Mount, N.C.; Ibaraki Seiki Machinery Co., Ltd., Ibaraki, Japan

[21] Appl. No.: 131,329

[22] Filed: Oct. 4, 1993

[51] Int. Cl.[6] ..... F26B 7/00

[52] U.S. Cl. ..... 34/389; 34/493; 34/216; 34/217; 34/526

[58] Field of Search ..... 34/209, 210, 215, 216, 34/217, 225, 229, 232, 233, 236, 44, 48, 52, 54, 30, 22, 380, 389, 443, 493, 487, 498, 526; 53/427

[56] References Cited

U.S. PATENT DOCUMENTS

| | | | |
|---|---|---|---|
| 3,309,835 | 3/1967 | Peppler | 53/30 |
| 3,616,546 | 11/1971 | Billingsley et al. | 34/217 |
| 4,676,006 | 6/1987 | Tolson | 34/217 |
| 4,738,082 | 4/1988 | Saitoh | 53/557 |
| 5,062,217 | 11/1991 | Tolson | 34/216 |
| 5,193,290 | 3/1993 | Tolson | 34/216 |

*Primary Examiner*—Denise L. Gromada
*Attorney, Agent, or Firm*—Olive & Olive

[57] ABSTRACT

The present invention provides a method and apparatus directed, in the first preferred embodiment, to insulating a selected portion of a heat shrinkable film prior to applying heat. The insulating material is a roller applied liquid such as water which acts as a partial thermal barrier and restricts shrinkage in the coated portions of film. Portions of the film to which no insulating material is applied are shrunk to a greater extent than portions to which insulating material is applied. According to a second embodiment, a moderate amount of heat is applied by a heating plate to a portion of the film bottom. Application of greater amounts of heat subsequently shrink other portions of the film to a greater extent, and the moderately shrunk selected portion retains a smooth and wrinkle-free surface. Both embodiments are adapted to improve the quality, appearance and readability of printed portions of the film wrap.

15 Claims, 4 Drawing Sheets

APPARATUS AND METHOD FOR DIFFERENTIALLY SHRINKING SELECTED PORTIONS OF HEAT SHRINKABLE FILM WRAPPED AROUND A PRODUCT

BACKGROUND OF THE INVENTION

1. Field of the Invention

This invention relates to apparatus and methods for shrinking heat shrinkable film wrapped about a product.

2. Description of the Related Art

It is common to wrap products in a plastic heat shrinkable film and then to shrink the film so as to both protect the product and to display it in a commercially attractive manner. In the initial process of wrapping, the film is typically sealed along the bottom of the product on a line parallel to the conveyor path and then sealed before and behind the product on a pair of lines perpendicular to the conveyor path. The result of this process is generally a product loosely wrapped in a sealed plastic film pouch. To make this film wrap commercially attractive, heat is applied to the film to cause it to shrink and achieve intimate wrinkle-free contact with the product contents.

The process described above is particularly common in food packaging, and especially in poultry packaging. An improved process for the shrinking of heat-shrinkable films is described in U.S. Pat. No. 5,193,290 for an APPARATUS AND METHOD FOR SEQUENTIAL SHRINKING OF PACKAGING FILM, the teaching of which is incorporated herein by reference.

The United States Department of Agriculture has recently issued a directive requiring that each retail package containing a meat product must be labeled with safe handling instructions concerning storage, preparation, cooking and preservation of leftovers. This new directive requires that the instructions be readable and that the direction of print on the top of the package be the same as on the bottom of the package. In response to this directive and for reasons of appearance and economy, it has been found desirable to print the information needed directly on the film in which the product is being wrapped rather than on a separate label. In the case of a tray in which poultry parts are packaged, the four lateral sides of the film wrapped around the tray are not suitable for such print because of the small size of the side area and the fact that the sides are typically tapered inwardly, which places the side areas generally out of view. The acceptable areas for printing an instruction panel are thus the bottom and the top surfaces of the film-wrapped package. Since a longitudinal seam is typically formed along the center of the tray bottom surface, the printing area on the film bottom is thus divided into two portions.

Whereas the apparatus and method of the U.S. Pat. No. '290 patent cited above has led to substantial improvement in the overall appearance of the top and side surfaces of the film on the poultry package, there was heretofore no concern about the appearance of the bottom surface or its suitability for carrying printed instructions. Upon attempting to shrink film printed in areas which correspond to the top and bottom of the tray containing poultry, it has been discovered that the bottom surface of the tray film tends to be excessively wrinkled, shrinks a considerable amount, and somewhat discolors due to the application of high heat. These combined effects cause the segments of print on the film package bottom to be unacceptable in appearance and unreadable.

It is therefore an object of this invention to provide an apparatus and method which enables heat shrink film wrapped around a package to be substantially wrinkle free on the top and the bottom surfaces after being shrunk so that information printed thereon is readable.

It is another object of this invention to provide an apparatus and method to shrink film wrapped around a package while preventing heat-caused discoloration of the film.

Other objects and advantages will be more fully apparent from the following disclosure and appended claims.

SUMMARY OF THE INVENTION

The invention provides a method and apparatus which enables a selected portion of a film wrapping a product to be shrunk relatively less when subjected to heat than other portions. In a first preferred embodiment a liquid is applied to a pre-printed lower portion of the film that is wrapped about the product prior to subjecting that lower portion to heat. The liquid acts as a heat insulator and the heat applied affects the extended edges of the film to a greater extent than the lower portion so as to shrink the bottom only moderately and the edges more. At a separate downstream station, heat is directed so as to shrink side portions and a top portion of the film wrapped around the package which shrinkage exerts tension on the printed bottom film portion to create a smooth, readable print on the bottom film.

The top film portion is typically caused to shrink by downwardly directed hot air or warm water. A final drying step may be optionally employed to remove the liquid residue from the film.

A second preferred embodiment utilizes a heated surface to impart a moderate amount of shrink to the pre-printed bottom film surface. The heated surface is covered by a rotating conveyor belt which is, in turn, in contact with the lower film surface to be shrunk. Further steps in the process sequentially apply heated fluids to selected parts of the film to cause such film to shrink according to the principles outlined above.

DETAILED DESCRIPTION OF THE INVENTION

Through the experience of processing poultry filled trays wrapped in film printed to comply with the recently promulgated requirements of the United States Department of Agriculture with heat shrink tunnel apparatus as disclosed in the prior art, it has been discovered that the information printed on the film often becomes difficult to read. The problem arises partially because the bottom portion of film tends to wrinkle, and partially because the heat employed according to the prior art causes some degree of discoloration of the ink and of the film. It is recognized that, if the degree of heat applied to the printed portions of film were to be reduced, wrinkling and discoloration would be minimized. However, it is also recognized that lower heat requires slower processing speed, thus costing more to process each tray.

It has been discovered that an application of a heat absorbing liquid, such as for example, water, to a printed portion of the heat shrinkable film prior to subjecting such printed film portion to a heat source tends to reduce the effect of the heat in causing excess film shrinkage and unwanted discoloration in that particular portion. In essence, the liquid acts as a heat barrier and thus reduces the extent of shrinkage caused by the heat applied.

Figure 1:
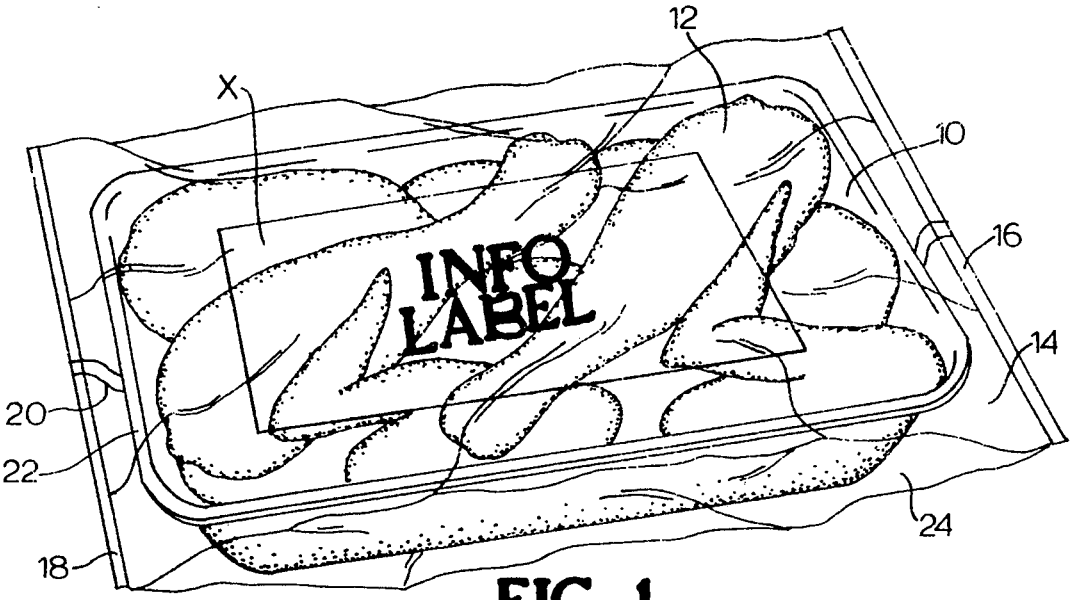
FIG. 1 is a perspective view of a wrapped, product filled tray sealed within a heat shrinkable film with an information label printed on the top surface and shown prior to being passed through the heat shrinking apparatus of the invention and illustrating the end seals extending outwardly from the tray flanges at each end of the tray.
Figure 2:
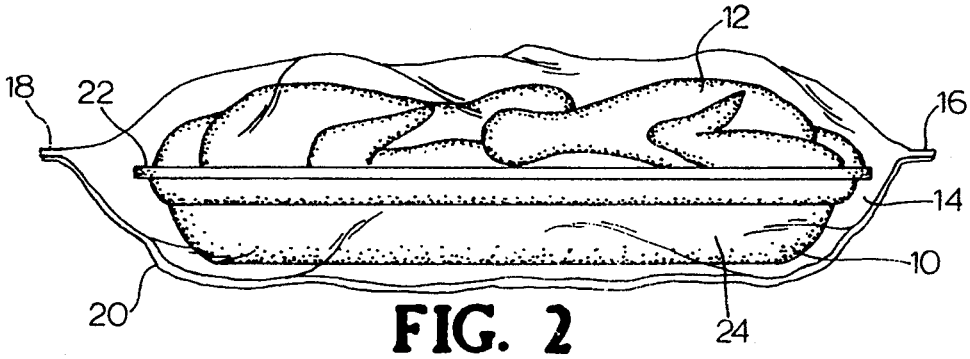
FIG. 2 is a side elevation view of the tray of FIG. 1, illustrating the position of the extending and sealed film edges prior to shrinking.
Figure 3:
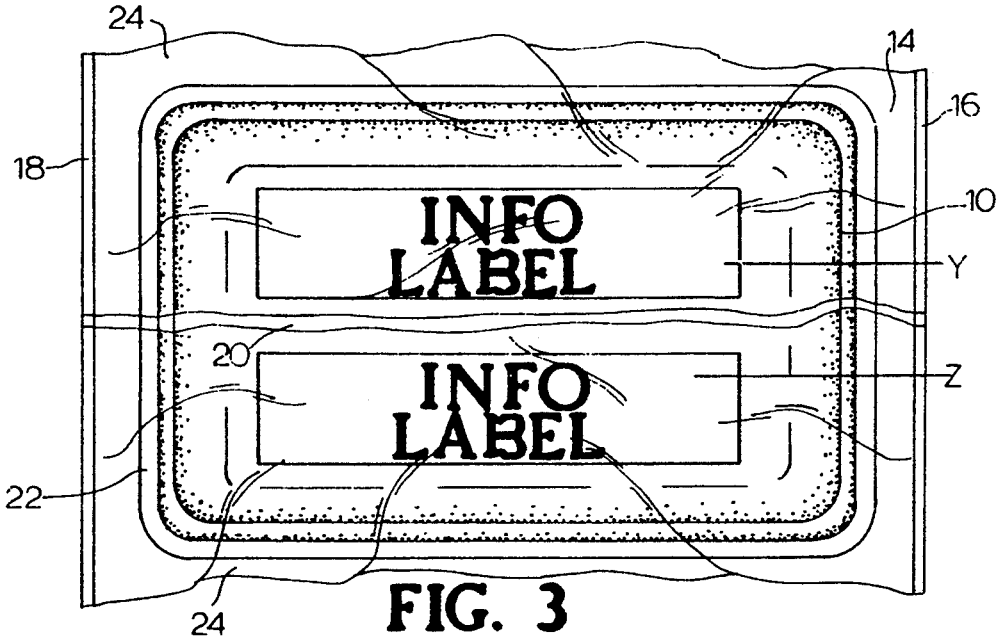
FIG. 3 is a bottom plan view of the tray of FIG. 1, illustrating the bottom central seam running longitudinally along the bottom of the tray and indicating two pre-printed information labels located on opposite sides of the seam.

With the foregoing in mind, FIGS. 1, 2 and 3 are illustrations of a poultry-filled tray 10 which has been wrapped in a heat shrinkable film 14 as is known in the trade and illustrating the tray as it appears before film shrinking. Tray 10 is first surrounded by a tube of the heat shrinkable film 14 which is then sealed longitudinally along a central bottom seam 20 according to known practice. Subsequently, end seams 16 and 18 are sealed in a direction transverse to bottom seam 20 to enclose tray 10 and product 12. At this stage, film 14 fits loosely around tray 10 and product 12, with end seams 16 and 18 protruding at opposite ends. Film 14 is illustrated as having been pre-printed in panel or label areas X, Y and Z which are positioned to overlie the top and bottom of the tray 10 so as to identify the product and convey required information about product storage, handling and preparation.

In order to complete the package for sales presentation, the heat shrinkable film 14 must be shrunk to create an acceptable final impression. For commercially acceptable appearance of the bottom portions of printing, panel or label areas Y and Z should be substantially flat, parallel and geometrically pleasing in shape. Firstly, the printed information of label areas X, Y and Z must be readable and not discolored. Secondly, the extended edges 16 and 18 must be drawn inwardly and downwardly to effectively hide beneath tray flanges 22. Similarly, the side portions 24 of the shrinkable film 14 must be pulled in neatly to enhance the appearance of the finished package.

Figure 4:
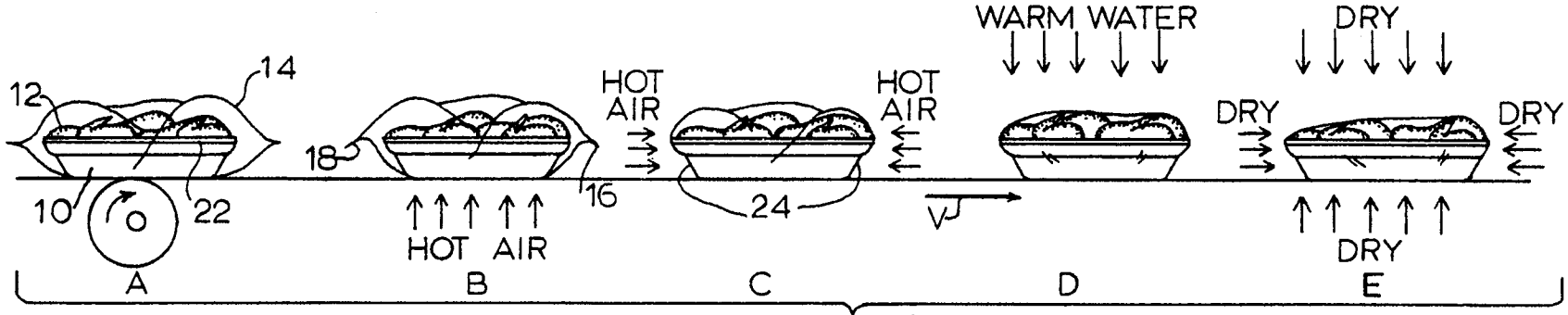
FIG. 4 is a schematic view of the method of the invention according to the first preferred embodiment.
Figure 5:
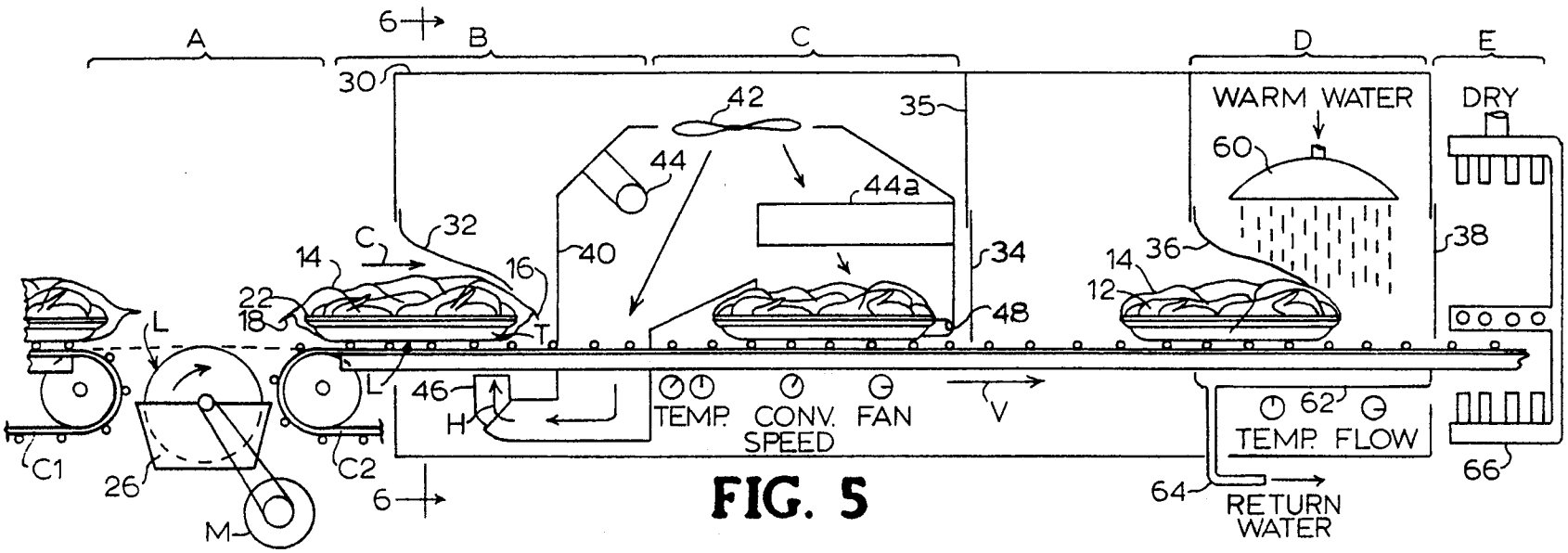
FIG. 5 is a schematic side view of the apparatus of the invention according to the first preferred embodiment with a series of film wrapped products being processed at each of sequential shrink stations A–E.

The steps involved in the method of the present invention follow the schematic illustration of FIG. 4 and the machine diagram of FIG. 5. Tray 10 is conveyed generally from an entry point by conveyor C1 in the direction indicated by arrow V through operative stations A–E, in each of which stations a specific function is performed in the process of shrinking film 14.

In station A, the lower portion of heat shrinkable film 14—wrapped tray 10 is coated with a thermally insulating material by being passed across a liquid applicator 26. Liquid applicator 26 comprises a roller which is mechanically driven by motor M at a speed such that the roller periphery moves at the same linear speed as the conveying speed. It is preferred that a roller covering such as a fabric or felt material is used to enhance liquid transfer. In other optional variations, a liquid applicator may be a tray-driven roller or a capillary medium such as, for example a wick having its bottom end immersed in the liquid. The preferred liquid L to be applied by liquid applicator 26 is water, which has been found to perform satisfactorily and is easy to remove and relatively neat. Depending on the particular film used, addition of from ½% to 5% by volume of a suitable surfactant chemical to the water, such as is commonly used to improve wetting, improves the water distribution on the film 14. Liquid applicator 26 is configured to be at least as wide as the width of the bottom of tray 10 and applies liquid to the entire lower portion of heat shrinkable film 14 (FIG. 5).

Tray 10 is next moved by conveyor C2 into shrink tunnel 30 past flexible curtain 32 to station B wherein hot air H, at a temperature sufficient to shrink film 14, is directed upwardly from outlet 46 below. Hot air H is blown between bars of roller conveyor C2 and initially impinges on the dry film of forward seam 16, causing it to shrink and pull downwardly, resulting in seam 16 residing below flange 22. The portions of film 14 in the vicinity of and including seams 16 and 18 are not coated with liquid. The hot air H blown from outlet 46 next impinges on the bottom surface of film 14 and contacts liquid L thereon such that the liquid L absorbs a portion of the heat and insulates the film from the full effect of the heat. Thus it has been determined that the bottom portion of film 14 is only moderately shrunk. The desired degree of shrinkage is controlled such that the lower printed panel or label portions Y and Z (FIG. 3) are smoothly tightened around tray 10. As trailing seam 18 passes outlet 46 and the source of hot air H, effective shrinking to pull seam 18 downwardly and inwardly occurs. The comparative degree of shrinkage between liquid coated and uncoated areas depends upon a number of factors, including speed of travel, hot air temperature, type of film and amount and type of liquid applied. Moderate shrinkage and greater shrinkage are defined to be comparative terms based in part on the readability of printed information.

Figure 6:
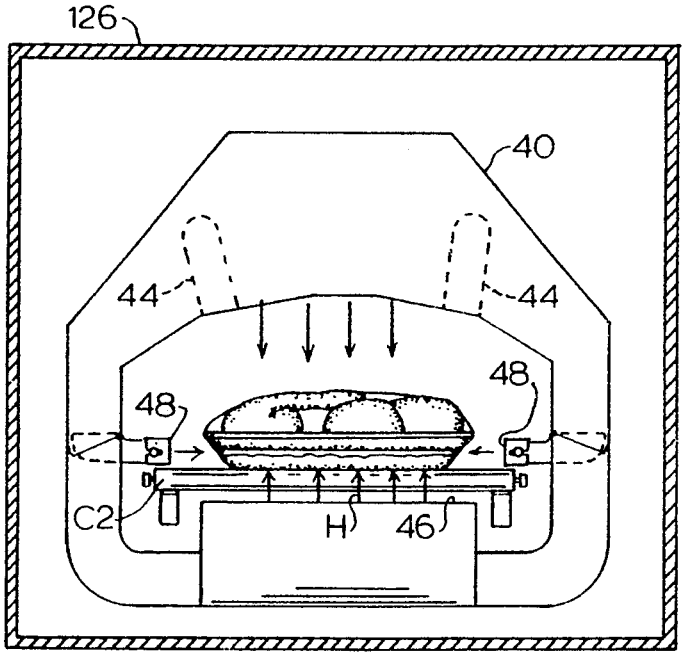
FIG. 6 is a schematic cross section view of the apparatus of the invention taken in the direction of line 6—6 of FIG. 5.

Wrapped tray 10 continues along the path of conveyor C2 and is impinged on the corresponding side sections of film 14 by hot air from a pair of opposed nozzles 48 in station C (see FIG. 6). At the completion of the shrink step of station C, forward and rear seams 16 and 18 and side portions 24 have been sufficiently shrunk so that the bottom and top portions of film surrounding tray 10 are somewhat tightened.

According to the teachings of the U.S. Pat. No. '290 patent mentioned above and also of the present invention, a final shrinking step involves applying warm water from an overhead nozzle 60 to the top portion of film 14 to remove any residual wrinkles and tighten film 14 particularly in the top portion. As described in the U.S. Pat. No. '290 patent, the moderate temperature of shrinking water will be effective to shrink film 14 without causing discoloration or harm to the product 12.

After passing out of shrink tunnel 30 through flexible curtain 38, the residual water on the surfaces of film 14 is removed by dry air directed to various sides by air jets 66. The drying air may be warm or cold, but is preferably not hot enough to further shrink film 14.

Figure 7:
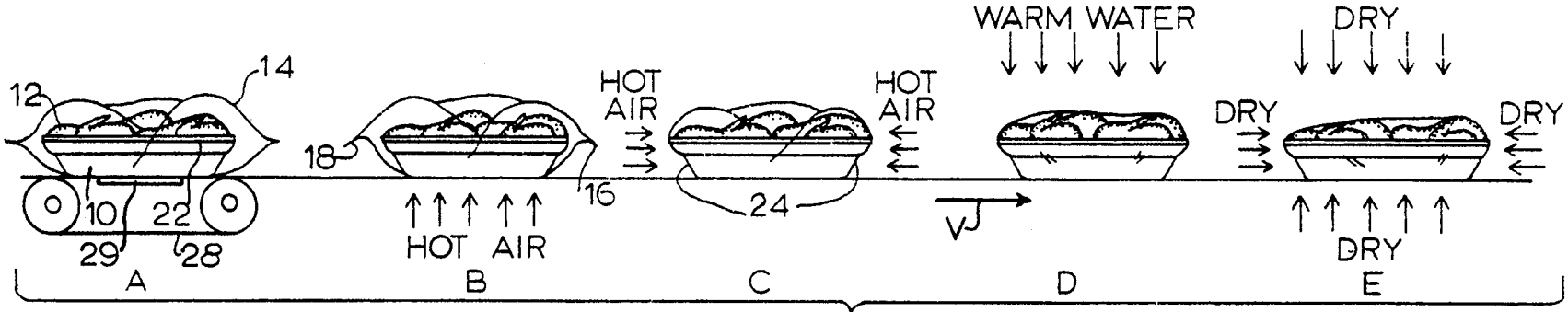
FIG. 7 is a schematic view of the method of the inversion according to the second preferred embodiment.

According to a second preferred embodiment of the invention, as shown in FIG. 7, film-wrapped tray 10, carrying product 12, is conveyed initially by drive belt 28, which surrounds and is in contact with heated plate 29. Both drive belt 28 and heated plate 29 are at least as wide as the width of the bottom of tray 10 and configured to be in thermally conductive contact therewith. Drive belt 28 consists of a material that is both flexible and able to tolerate high temperatures and conduct heat readily. A material such as teflon coated fiberglass fabric is useful for this heat transmissive belting. The operating temperature of heated plate 29 is set to cause a minor amount of shrinkage to the bottom portion of film 14 at the intended linear operating speed of the conveyor system.

By imparting an initial moderate shrink to the bottom portion of film 14 by the application of moderate heat, subsequent exposure to hot air in station B tends to not significantly further shrink or distort the film and information printed thereon. In effect, steps A and B of the first embodiment of the invention as portrayed in FIG. 4 are collectively equivalent to steps A and B of the second embodiment as portrayed in FIG. 7. Thus, in either embodiment, steps A and B are grouped to cause a moderate shrinkage of the film bottom surface and a greater shrinkage of film leading and trailing edges. The further steps C–E of FIG. 7 are similar to steps C–E of FIG. 4 discussed above.

Figure 8:
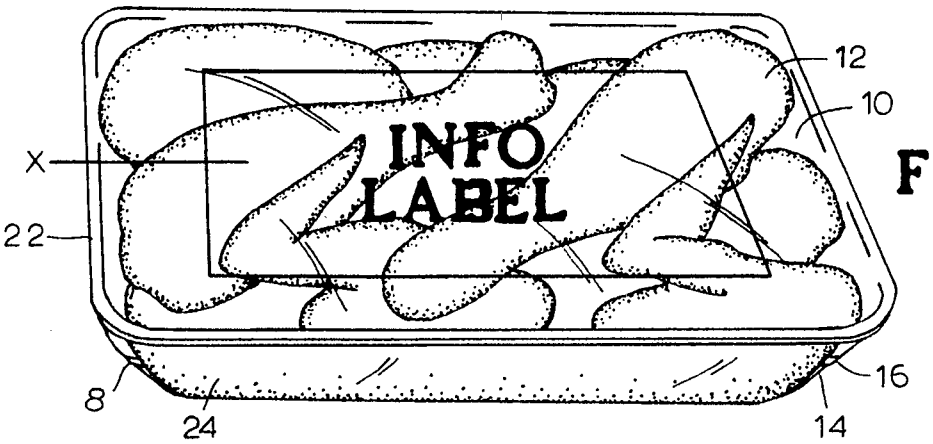
FIG. 8 is a perspective view of a film wrapped tray after being processed according to the first embodiment of the invention.
Figure 9:
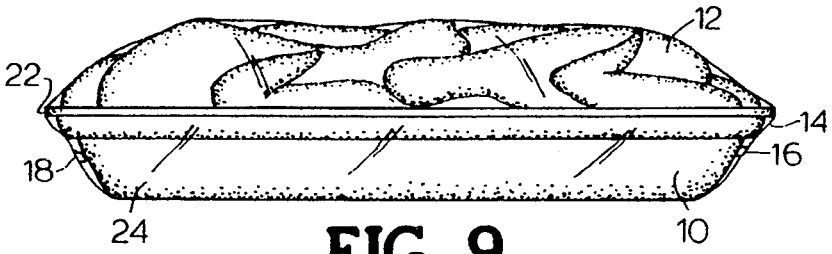
FIG. 9 is a side elevation view of the film wrapped tray of FIG. 8.
Figure 10:
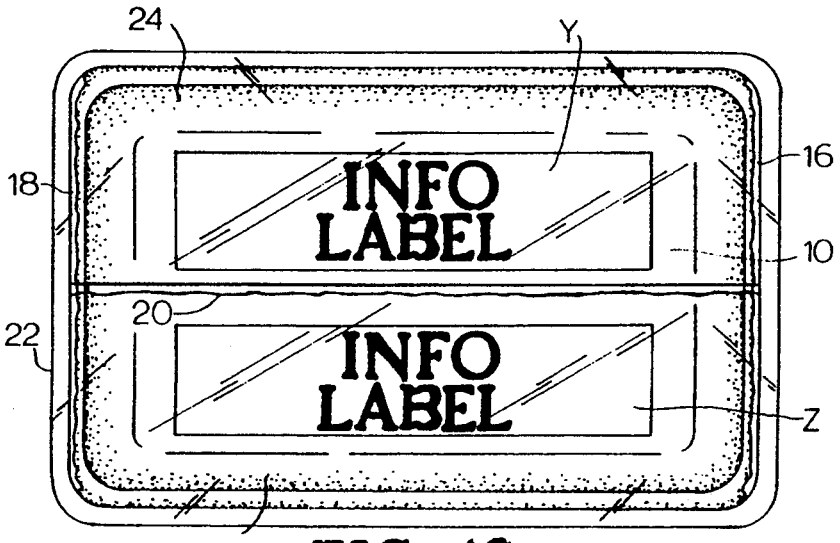
FIG. 10 is a bottom plan view of the film wrapped tray of FIG. 8.

FIGS. 8, 9 and 10 illustrate respective top, side and bottom surfaces of film after processing according to the present invention with printed label areas X, Y and Z relatively wrinkle-free and readable.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A method for differentially shrinking selected portions of heat shrinkable film wrapped around a product, comprising the steps of:

(a) applying a thermally insulating removable material to a selected portion of said heat shrinkable film; and (b) exposing said heat shrinkable film to a first source of heat sufficient to shrink said film such that said selected portion is shrunk to a moderate extent and other portions of said film to which said insulating material has not been applied are shrunk to a greater extent.

2. The method for differentially shrinking selected portions of heat shrinkable film wrapped around a product as described in claim 1, further comprising the step of exposing said heat shrinkable film a second source of heat adapted to shrink an additional portion of said film to which no thermally insulating material has been applied.

3. The method for differentially shrinking selected portions of heat shrinkable film wrapped around a product as described in claim 1, further comprising the step of removing said insulating material from said film after shrinking said film.

4. The method for differentially shrinking selected portions of heat shrinkable film wrapped around a product as described in claim 1, wherein said insulating material is an insulative liquid.

5. The method for differentially shrinking selected portions of heat shrinkable film wrapped around a product as described in claim 4, wherein said insulative liquid is water.

6. The method for differentially shrinking selected portions of heat shrinkable film wrapped around a product as described in claim 5, further comprising the step of adding a surfactant chemical to the water.

7. A method for differentially shrinking selected portions of heat shrinkable film wrapped around a product, comprising the steps of:

(a) moderately shrinking a selected portion of said heat shrinkable film by first applying a thermally insulating liquid to said selected portion and then exposing said selected portion to a source of heat sufficient to cause shrinkage of said film; and (b) shrinking other portions of said heat shrinkable film than said selected portion to a greater extent than the extent of shrinkage of said selected portion.

8. The method for differentially shrinking selected portions of heat shrinkable film wrapped around a product as claimed in claim 7 wherein the step of moderately shrinking a selected portion of said heat shrinkable film further comprises first applying a moderate amount of heat to said selected portion of film and then applying a greater amount of heat to a portion of said film which is greater than and includes said selected portion of said film.

9. The method for differently shrinking selected portions of heat shrinkable film wrapped around a product as claimed in claim 7, wherein said thermally insulating liquid is water.

10. The method for differentially shrinking selected portions of heat shrinkable film wrapped around a product as described in claim 9, further comprising the step of adding a surfactant chemical to the water.

11. The method for differentially shrinking selected portions of heat shrinkable film wrapped around a product as claimed in claim 7, wherein said source of heat to which portions of said film are exposed comprises heated air.

12. The method for differentially shrinking selected portions of heat shrinkable film wrapped around a product as claimed in claim 7, further comprising the step of removing said insulating liquid subsequent to completing the steps of shrinking.

13. A method for differentially shrinking selected portions of heat shrinkable film wrapped around a product having bottom, side and top portions, said method comprising the steps of:

(a) applying in sequence a thermally insulating removable material and a moderate amount of heat to a selected portion of the bottom of said film so as to selectively, moderately shrink said selected portion thereof;

(b) applying a greater amount of heat to said bottom so that said film is caused to shrink to a greater degree in other than said selected portion;

(c) applying heat to side portions of said heat shrinkable film to cause said side portions to shrink; and (d) applying heat to a top portion of said heat shrinkable film to cause said top portion to shrink.

14. An apparatus for differentially shrinking selected portions of heat shrinkable film wrapped around a product, comprising: (a) means to convey a film wrapped product along a conveyor path; (b) means at a first location along said conveyor path to apply a thermally insulating material to a selected portion of said film;

(c) means at a second location along said conveyor path to apply heat to said selected portion of said film so as to moderately shrink said selected portion of said film;

(d) means at a third location along said conveyor path to apply heat to other portions of said film so as to shrink other portions of said film; and (e) means at a fourth location along said conveyor path to remove said insulating material from said selected portion of said film.

15. An apparatus for differentially shrinking selected portions of heat shrinkable film wrapped around a product, comprising:

(a) means to convey a film wrapped product along a conveyor path;

(b) means at a first location along a conveyor path to apply in sequence both a thermally insulating removable material and a moderate amount of heat to a selected portion of said film so as to shrink said selected portion; and (c) means at a second location along said conveyor path to apply a greater amount of heat to portions of said film including said selected portion so as to shrink other portions to a substantially greater extent than said selected portion.

* * * * *